United States Patent [19]

Nethery

[11] 4,362,499

[45] Dec. 7, 1982

[54] COMBUSTION CONTROL SYSTEM AND METHOD

[75] Inventor: Stanton K. Nethery, Marshalltown, Iowa

[73] Assignee: Fisher Controls Company, Inc., Marshalltown, Iowa

[21] Appl. No.: 220,694

[22] Filed: Dec. 29, 1980

[51] Int. Cl.[3] ..... F23N 5/00

[52] U.S. Cl. ..... 431/12; 236/15 E; 431/76

[58] Field of Search ..... 236/15 E, 15 BD; 431/76, 12

[56] References Cited

U.S. PATENT DOCUMENTS

| | | | |
|---|---|---|---|
| Re. 25,722 | 1/1965 | Dykeman et al. . | |
| 1,562,087 | 11/1925 | Griswold . | |
| 1,770,059 | 7/1930 | Barber . | |
| 2,285,564 | 6/1942 | Brooke, Jr. et al. . | |
| 2,545,732 | 3/1951 | Hamilton . | |
| 3,123,295 | 3/1964 | Martin . | |
| 3,224,838 | 12/1965 | Evans et al. . | |
| 3,288,199 | 11/1966 | Gerrard et al. . | |
| 3,503,553 | 3/1970 | Schomaker . | |
| 3,514,085 | 5/1970 | Woock . | |
| 3,723,047 | 3/1973 | de Livois . | |
| 3,745,768 | 7/1973 | Zechnall et al. . | |
| 3,926,154 | 12/1975 | Williams . | |
| 3,962,867 | 6/1976 | Ikeura et al. . | |
| 4,022,171 | 5/1977 | Laprade et al. . | |
| 4,031,866 | 6/1977 | Asano . | |
| 4,032,285 | 6/1977 | Rohr et al. . | |
| 4,036,592 | 7/1977 | Brown et al. . | |
| 4,078,880 | 3/1978 | Hunziker . | |
| 4,097,218 | 6/1978 | Womack . | |
| 4,141,214 | 2/1979 | Mitsuda et al. . | |
| 4,162,889 | 7/1979 | Shigemura . | |
| 4,163,433 | 8/1979 | Fujishuro . | |
| 4,194,471 | 3/1980 | Baresel . | |
| 4,296,727 | 10/1981 | Bryan | 431/76 X |
| 4,330,260 | 5/1982 | Jorgensen | 431/12 |

OTHER PUBLICATIONS

Anson, et al. "Carbon Monoxide As a Combustion Control Parameter" from Combustion Magazine 1972.

Grant "The Use of Boiler Flue Gas Analysis for Combustion Control in Oil Fired Power Plant", Oil and Gas Firing, 1974.

Fisher Controls manual, Nov. 1978, Section entitled "Combustion Control and Automatic $O_2$ Correction", pp. 1–13.

*Primary Examiner*—William E. Wayner

*Attorney, Agent, or Firm*—Allegretti, Newitt, Witcoff & McAndrews

[57] ABSTRACT

A combustion control system for a furnace monitors the oxygen content, carbon monoxide content and temperature in the flue gas exhausting from the combustion chamber. These parameters are used to calculate total heat loss due to unreacted oxygen and the other excessive air components associated therewith, and carbon monoxide. Such heat loss calculations are continuously made and compared to determine whether total heat loss, oxygen related heat loss and carbon monoxide heat loss are increasing or decreasing. Depending upon the combination of increase and decrease associated with the various heat losses, the combustion air supply is increased or decreased. In this manner it is possible to minimize heat loss and maximize furnace efficiency even though the combustion characteristics of the combustion unit may change with time.

4 Claims, 2 Drawing Figures

COMBUSTION CONTROL SYSTEM AND METHOD

BACKGROUND OF THE INVENTION

This invention relates to an improved method and apparatus for controlling the efficiency of a combustion device, particularly a furnace of the type for combusting a hydrocarbon fuel. The present invention is useful in a combustion device wherein the rate of flow of fuel, the quality of fuel or the characteristics of the combustion device itself can vary as a function of time.

Generally there are two specific types of combustion control systems: (1) direct positioning combustion control, and (2) metering combustion control. These two combustion control systems have two subsystems: (1) a fuel control subsystem and (2) a combustion air control subsystem.

An example of a direct positioning combustion control system can be found in a boiler control system wherein a pressure sensor transmits signals directly to a combustion fuel valve and to an air damper thereby controlling these inputs in order to control or maintain a fixed pressure output from the boiler associated with the combustion device. Fuel flow and air flow are not measured. Such a control system operates satisfactorily as long as the fuel has a constant BTU value. When the fuel BTU value changes, the preset relative positions of the fuel valve and air damper cannot change automatically since there is a fixed relationship between fuel flow and air flow that is calibrated into the system.

Metering combustion control systems are subdivided into three categories which control the fuel air input to the combustion chamber and the ratio of the fuel and air input. When changing the fuel air input, each of these three potential systems accomplish the change in various ways. One of the systems is known as series-metering combustion control. A second system is known as parallel-metering combustion control, and the third system is known as the lead-lag metering combustion control. All of these systems are known to those skilled in the art and are responsive to demand requirements associated with a combustion system.

The various systems also may include an automatic oxygen control or air flow correction in order to improve combustion efficiency. Typically the excess air for combustion is controlled by controlling the percent of oxygen in the flue gas. Such a system is an improvement over a manual adjustment of the fuel/air ratio because manual adjustment does not provide for automatic compensation to changes in BTU content of the fuel and therefore often requires excess air to maintain safe boiler operation. As a result, combustion efficiency decreases.

Flue gas analysis has been used as a combustion control technique for the combustion process. Typically, the flue gas includes the products of combustion, carbon dioxide and water vapor. Additionally, excess air including oxygen as well as the product of incomplete combustion, carbon monoxide, will be found in the flue gas. Finally, the flue gas may contain other gases such as nitrogen, gas compounds and solid particulates which are the product of combustion or which are impurities.

In any event, monitoring the carbon monoxide or oxygen content in the flue gas has previously been suggested as a technique for providing a control parameter for controlling the efficiency of operation of a furnace.

Anson et al, in his article "Carbon Monoxide as a Combustion Control Parameter", Combustion Magazine, March 1972, discloses how carbon monoxide may be used for this purpose. Similar control techniques are discussed by Grant in "The Use of Boiler Flue Gas Analyses for Combustion Control and Oil Fired Power Plant", Oil and Gas Firing, April 1974.

Shigemura, in U.S. Pat. No. 4,162,889 entitled "Method and Apparatus for Control of Efficiency in Combustion in a Furnace" teaches a system which relies upon the theoretical oxygen level required for combustion in order to control combustion efficiency. Shigamura controls air flow to the combustion chamber by monitoring the oxygen level in the flue gas and comparing the monitored oxygen level with a set, calculated oxygen level. The set point for the oxygen may be altered from time to time by monitoring the level of carbon monoxide in the flue gas.

Various other patents teach additional types of combustion control mechanisms which seek to maximize the efficiency of the combustion process. Typically these combustion control mechanisms are used in furnace applications, for boilers and for automobile engines. Additionally, it is typical that these prior art references teach the monitoring of carbon monoxide or oxygen and then vary fuel or air input in response to the difference between the monitored values and set point values. Following is a listing of known prior art patents considered typical of the described approach:

| Pat. No. | Inventor | Title | Issue Date |
|---|---|---|---|
| 1,562,087 | Griswold | Method of and Apparatus for Controlling Combustion | 11/17/25 |
| 1,770,059 | Barber | Combustion Control | 7/08/30 |
| 2,285,564 | Brooke, Jr., et al | Combustion Control | 6/09/42 |
| 2,545,732 | Hamilton | Combustion Control | 3/20/51 |
| 3,123,295 | Martin | Means for Analyzing Combustion Products and Varying Air Fuel Ratio | 3/03/64 |
| Re.25,722 | Dykeman, et al | Apparatus for Controlling the Operation of Multiple Combustion Zones | 1/26/65 |
| 3,288,199 | Gerrard, et al | Low Excess Air Operation of Multiple-Burner Residual-Fuel-Fired Furnaces | 11/29/66 |
| 3,503,553 | Schomaker | Fuel Metering Combustion Control System with Automatic Oxygen Compensation | 3/31/70 |
| 3,514,085 | Woock | Combustion Chamber Atmosphere Control | 5/26/70 |
| 3,723,047 | de Livois | Control Network for Burning Fuel Oil and Gases with Reduced Excess Air | 3/27/73 |
| 3,745,768 | Zechnall, et al | Apparatus to Control the Proportion of Air and Fuel in the Air-Fuel Mixture of Internal Combustion Engines | 7/17/73 |
| 3,926,154 | Williams | Fuel Control Systems | 12/16/75 |
| 4,022,171 | Laprade, et al | Process and Device for Controlling an Electric Valve for Regulating the Supply of the Fuel Air Mixture to Internal Combustion Engines | 5/10/77 |
| 4,031,866 | Asano | Closed Loop Electronic Fuel Injection Control Unit | 6/28/77 |

-continued

| Pat. No. | Inventor | Title | Issue Date |
|---|---|---|---|
| 4,032,285 | Rohr, et al | Method and Apparatus for the Automatic Control of the Air Ratio of a Combustion Process | 6/28/77 |
| 4,097,218 | Womack | Means and Method for Controlling Excess Air Inflow | 6/27/78 |
| 4,163,433 | Fujishuro | Air/Fuel Ratio Control System for Internal Combustion Engine Having Compensation Means for Variation in Output Characteristic of Exhaust Sensor | 8/07/79 |
| 4,194,471 | Baresel | Internal Combustion Engine Exhaust Gas Minitoring System | 3/25/80 |

While the systems described do provide a means to increase the efficiency of combustion units and engines, the systems do not satisfactorily take into account changes in characteristics in the combustion device itself. That is, as a combustion device passes through a cycle during which it is heated, the characteristics of the device will, to some degree, change. These changes in the unit require a committent change in the fuel/air ratio in order to maximize combustion efficiency. Thus, a set point for oxygen or carbon monoxide sensing in the flue gas will not provide satisfactory control. An original base set point in the system will not provide satisfactory control. The present invention provides a method and apparatus for maximizing combustion efficiency without using fixed set points.

SUMMARY OF THE INVENTION

Briefly, the present invention comprises apparatus for controlling the air supply for combustion in a combustion chamber. The combustion chamber is of the type which includes a fuel supply to the chamber, an air supply to the chamber and a flue gas or exhaust gas flow from the chamber. The apparatus includes means for continuously sensing and monitoring the concentration of oxygen in the flue gas, the concentration of carbon monoxide in the flue gas and the temperature of the flue gas. Means are also provided to calculate the sensible heat loss due to unreacted oxygen and the other excessive air components associated therewith in the flue gas as well as sensible and reactive heat loss due to unreacted carbon monoxide in the flue gas using the sensed temperature and concentration information. The various heat losses are then summed to provide a total heat loss. Additionally, means is provided to determine the sign of the quantitative change in heat loss overall and for each of the sensed flue gases, oxygen and the other excessive air components associated therewith, and carbon monoxide. Using this information, the air supply is controlled in response to the signs, i.e., increase or decrease of various heat losses, to thereby minimize total heat loss and effectively eliminate the change in total heat loss.

Thus, it is an object of the present invention to provide an improved combustion control apparatus and method.

It is a further object of the present invention to provide an improved combustion control apparatus which utilizes sensors that monitor the temperature of flue gas, and the concentration of oxygen and carbon monoxide in the flue gas continuously.

A still further object of the present invention is to provide a combustion control process which maximizes the efficiency of a combustion reaction regardless of the external fuel supply settings and other settings of the system. The system is thus substantially self-correcting and self-maximizing.

Still a further object of the present invention is to provide an economical and simple method and apparatus for maximizing the efficiency of a combustion process.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
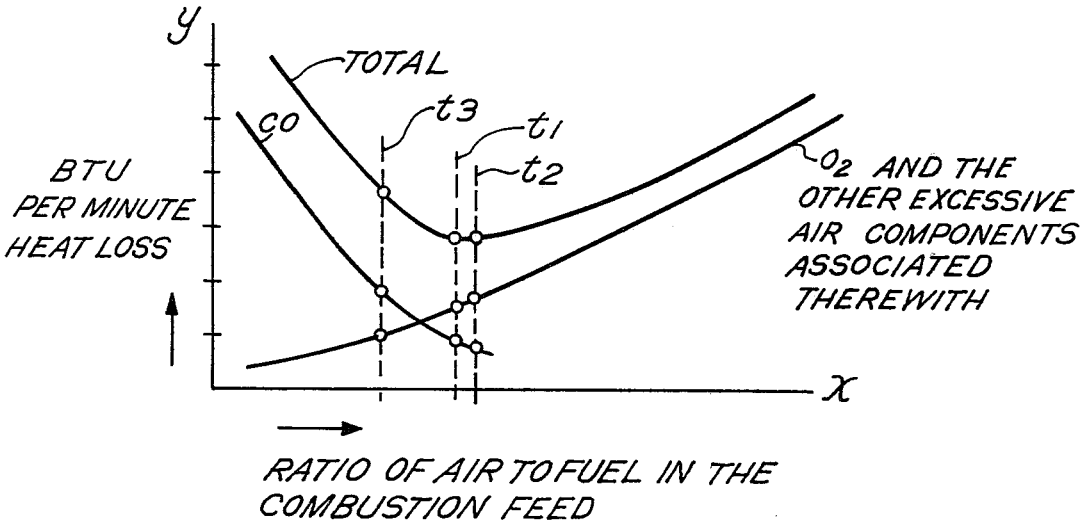
FIG. 1 is a graph illustrating the heat loss associated with flue gas and the constituents of flue gas.

As an introduction to the present invention, reference is made to FIG. 1 which is a graph illustrating one component of flue gas heat loss for a combustion device; namely, the sensible heat loss of unreacted oxygen ($O_2$) and the other excessive air components associated therewith in the flue gas and the sensible heat loss as well as heat loss associated with the oxidizing reaction of the carbon monoxide ($C_2$) in the flue gas. Thus, the y axis represents heat loss in BTUs per unit of time and the x axis represents the quantitative ratio of air-to-fuel in the combustion feed. For carbon monoxide, typically the graph of this information is represented by a complex negative sloped curved; whereas, for oxygen, the graph of this information is represented by a complex positive sloped curved. The total heat loss associated with the flue products, oxygen and carbon monoxide, is represented by the third complex parabolic type curve which constitutes the sum of the carbon monoxide and oxygen curves.

The present invention contemplates calculating the flue gas heat losses at specific times, $t_1$, $t_2$, and $t_3$ for each of the gases, oxygen and carbon monoxide. Also, the total heat loss is determined. Thus, at each particular time, $t_1$, a first set of data is taken; namely, the quantity of oxygen, the quantity of carbon monoxide and the flue gas temperature. This data can then be used to calculate heat losses as shown in FIG. 1. At a subsequent time, $t_2$, a second set of data is taken and calculations for heat loss made and likewise at a third time, $t_3$, a third set of data is taken and calculated for heat loss made.

This data can then be compared to determine not only the gross amount of heat loss associated with carbon monoxide, oxygen and the sum thereof, but also the direction (increasing or decreasing) of quantitative change associated with the measurements of each time, $t_1$, $t_2$ and $t_3$. Thus, it is possible to determine whether the total heat loss increases or decreases between times $t_1$ and $t_2$, whether the heat loss associated with oxygen increases or decreases and, finally, whether the heat loss associated with carbon monoxide increases or decreases between specific time intervals.

It has been determined that by looking at the sign associated with the heat loss changes, it is possible to determine whether the inlet air flow should be increased or decreased. The following table, Table I, summarizes the manner in which air flow to the combustion chamber should be adjusted to increase the efficiency of the combustion device:

TABLE I

| Calculated Total Heat Loss Change | Calculated Oxygen Heat Loss Change | Calculated Carbon Heat Loss Change | Combustion Air Supply Control Response |
|---|---|---|---|
| Decrease (−) | Decrease (−) | Increase (+) | Decrease (−) |
| Decrease (−) | Increase (+) | Decrease (−) | Increase (+) |
| Increase (+) | Decrease (−) | Increase (+) | Increase (+) |
| Increase (+) | Increase (+) | Decrease (−) | Decrease (−) |

Summarizing the above table, it can be seen that when the total heat loss decreases and the heat loss associated with the flue gas oxygen decreases as the carbon monoxide heat loss increases over time, a decrease in the combustion air supply is appropriate to cause a decrease in total heat loss which, of course, is desired. When the total heat loss decreases and the oxygen heat loss increases as carbon monoxide heat loss also decreases, an increase in combustion air is required to improve efficiency.

When the total heat loss increases and the oxygen air heat loss decreases as the carbon monoxide heat loss increases, an increase in combustion air is desired. Finally, when the total heat loss increases and the oxygen heat loss increases as the carbon monoxide heat loss decreases, a decrease in the combustion air will cause desired decrease of the total heat loss.

Arranging apparatus to accomplish or control inlet combustion air or supply air in the manner described will tend to minimize the energy heat loss associated with a combustion device and will also maximize the efficiency of the device. A device operating in the manner described using proper sensing, monitoring and calculating means automatically provides for control of the burning of fuel at the optimum level.

Figure 2:
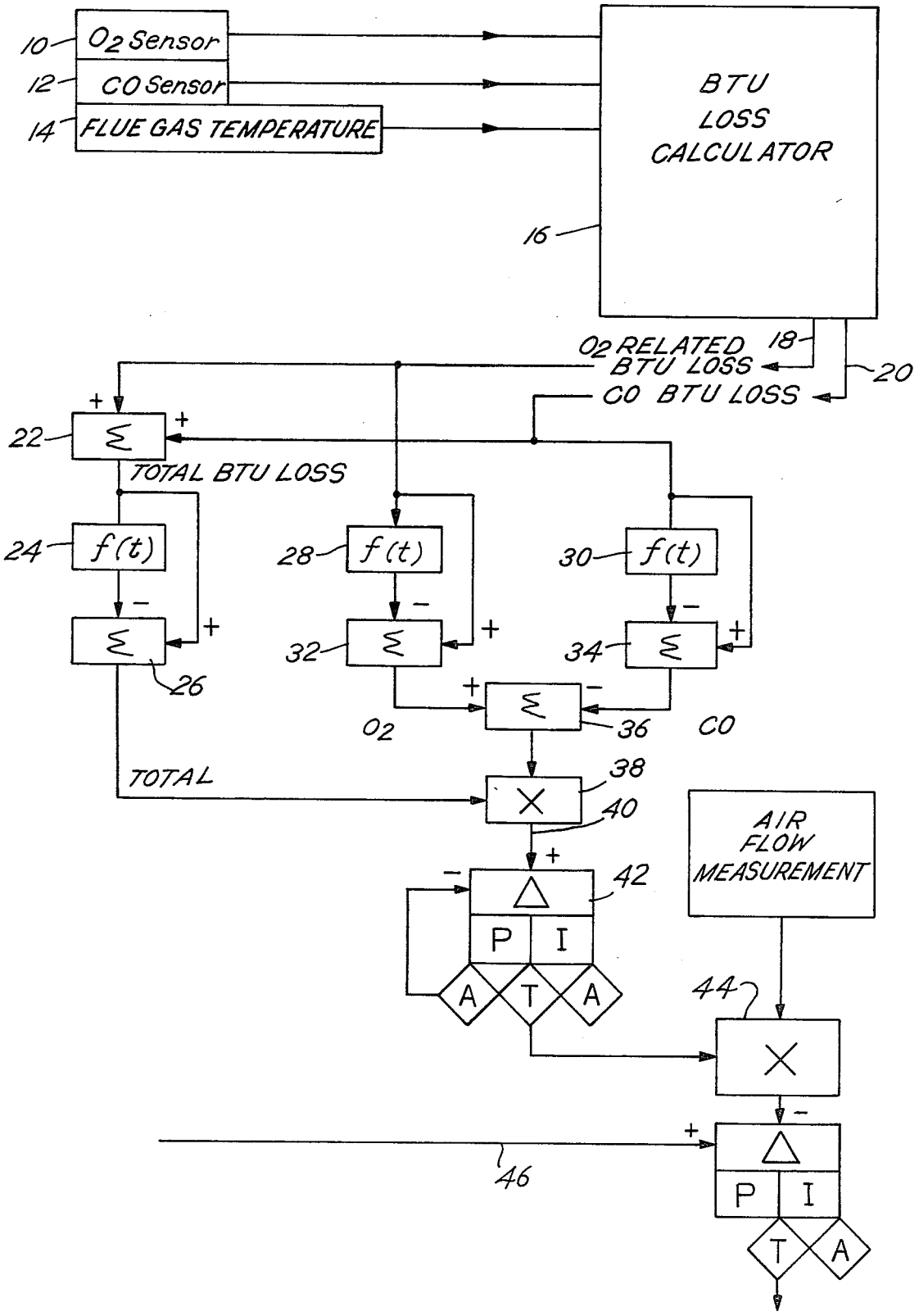
FIG. 2 is a diagram showing the component parts of the improved combustion control apparatus and method of the present invention.

FIG. 2 is a schematic diagram illustrating the sensing, monitoring and control devices as arranged in a package to provide the combustion control method and apparatus of the invention. Specifically referring to FIG. 2, an oxygen sensor 10, typically an in-situ oxygen analyzer using a zirconium based sensor, is provided in the flue gas outlet of the combustion device. Likewise, a carbon monoxide sensor 12, typically an infra-red spectrometer based analyzer, and a temperature sensor or thermocouple 14 are provided.

These sensors 10, 12 and 14 provide signals which are combined and otherwise operated upon in a calculator 16, for example a digital or analog computer, to provide a computation of the BTU loss associated with sensible heat loss of oxygen and the other excessive air components associated therewith in the flue gas, and the BTU loss associated with sensible heat loss and unreacted carbon monoxide heat loss in the flue gas. These calculated figures are typically provided in the form of signals 18 for the oxygen and 20 for the carbon monoxide.

A summing device 22 totals the BTU heat loss at a given time. This process is constantly being carried out at defined times $t_1$, $t_2$, $t_3$, etc. as suggested by FIG. 1. In this manner the total BTU loss as calculated by summing device 22 may be stored in a time delay or storage device 24, for example, a digital or analog first order lag module, and compared with a subsequent BTU calculation in a comparator 26 to determine whether the BTU loss over a time increment is increasing or decreasing. A time delay device 28 is also provided for the oxygen related BTU loss as calculated and a time delay device 30 is provided for the carbon monoxide BTU loss as calculated. Comparators 32 and 34 are provided for the oxygen related and carbon monoxide respectively. Thus, a signal may be provided by each comparator 32, 34 respectively which is indicative of the BTU increase or decrease over a time increment.

The signals from the comparators 26, 32 and 34 are then compared to each other in master comparator devices 36 and 38 to provide a final ultimate output signal 40 signal 40 serves as an input to a controller 42 that controls a fuel to air ratio multiplier module 44. In this manner the amount of air flow for mixture with fuel through line 46 is controlled so that the total combustion reaction within the furnace may be controlled. The sign of control signals to effect control of the fuel to air ratio multiplier module 44 is set forth in parentheses in Table I above.

It should be noted that the fuel to air ratio multiplier module 44 may, in fact, be a fine control in combination with a combustion device wherein a gross or general setting for air flow may be preset and controlled in one of the conventional prior art manners; for example, set point monitoring of the oxygen content. Thus, the method and apparatus of the present invention may be used alone or in combination with other sensing and control systems. The present invention provides an efficient and simple way to maximize engine efficiency by monitoring the flue gas constituents and temperatures and changes thereof. With the present invention, the curve, as exemplified by FIG. 1, for the total heat loss may thus change in shape from time to time depending upon the fuel being used, the quality of the fuel being used, the quantity being used, changes in characteristics of the combustion unit itself and various other factors. Such a change in the curve of the type shown in FIG. 1 will, however, be automatically accommodated by the present invention. Thus, there are many variations and alternative methods which may be used in combination with the present invention. Also, various other apparatus may be used to accomplish the goals and objectives of the present invention. The invention, therefore, is to be limited only by the following claims and their equivalents.

What is claimed:

1. Apparatus for controlling the air supply for combustion in a combustion chamber of the type including a fuel supply to the chamber, an air supply to the chamber and a flue gas exhaust from the chamber, said apparatus designed to mininize combustion reaction energy loss and to maximize combustion efficiency, said apparatus comprising, in combination:

means for continuously sensing and monitoring the concentration of oxygen in the flue gas;

means for continuously sensing and monitoring the concentration of carbon monoxide in the flue gas;

means for continuously sensing and monitoring temperature of the flue gas;

means for calculating sensible heat loss due to unreacted oxygen and the other excessive air components associated therewith in the flue gas using the sensed and monitored temperature and concentration of oxygen in the flue gas;

means for calculating the sensible and reactive heat loss due to unreacted carbon monoxide in the flue gas using the sensed and monitored temperature and concentration of carbon monoxide in the flue gas;

means for summing the heat losses to determine a total heat loss;

means for determining the sign of the quantitative change in heat loss for each calculated heat loss and the total heat loss during a time increment between serial calculations of each heat loss;

means for controlling air supply in response to the signs of quantitative heat loss change to minimize total heat loss and to eliminate the change in total heat loss over time.

2. The apparatus of claim 1 wherein the means for controlling air supply operates to increase air supply whenever the sign of heat loss change for oxygen increases, carbon monoxide decreases and the total decreases, and whenever the sign of heat loss change for oxygen decreases, carbon monoxide increases and the total increases.

3. The apparatus of claim 1 wherein the means for controlling air supply operates to decrease air supply whenever the sign of heat loss change for oxygen decreases, carbon monoxide increases and the total decreases and whenever the sign of heat loss change for oxygen increases, carbon monoxide decreases and the total increases.

4. A method for controlling the air supply for combustion in a combustion chamber of the type including a fuel supply to the chamber, an air supply to the chamber and a flue gas exhaust from the chamber comprising the steps of:

measuring the flue gas temperature, oxygen content and carbon monoxide content at succeeding time increments;

calculating the sensible heat loss due to unreacted oxygen and the other excessive air components associated therewith in the flue gas at succeeding time increments;

calculating the sensible and unreactive heat loss due to carbon monoxide in the flue gas at succeeding time increments;

calculating the total heat loss due to carbon monoxide and oxygen and the other excessive air components associated therewith in the flue gas at succeeding time increments;

determining the sign of the quantitative change in heat loss due to oxygen, carbon monoxide and the total thereof;

increasing the air supply when the determined sign for oxygen increases, for carbon monoxide decreases and the total decreases and when the determined sign for oxygen decreases, carbon monoxide decreases and total increases; and decreasing the air supply when the determined sign for oxygen decreases, carbon monoxide increases and total decreases, and when the determined sign for oxygen increases, carbon monoxide decreases and the total increases.

* * * * *